US006652927B1

(12) United States Patent
Chen

(10) Patent No.: US 6,652,927 B1
(45) Date of Patent: Nov. 25, 2003

(54) SIMULATED CHRISTMAS TREE

(75) Inventor: Fred Chen, Taipei (TW)

(73) Assignee: Collins International Co., Ltd., Fair Lawn, NJ (US)

( * ) Notice: Subject to any disclaimer, the term of this patent is extended or adjusted under 35 U.S.C. 154(b) by 0 days.

(21) Appl. No.: 10/051,500

(22) Filed: Jan. 18, 2002

Related U.S. Application Data

(60) Provisional application No. 60/263,023, filed on Jan. 19, 2001.

(51) Int. Cl.[7] ..... F21P 1/00

(52) U.S. Cl. ..... 428/7; 428/15; 428/18; 428/3; 428/9; 428/11; 428/7; 362/252; 362/123; 362/249

(58) Field of Search ..... 428/15, 18, 3, 428/7, 9, 11; 362/252, 123, 249

(56) References Cited

U.S. PATENT DOCUMENTS

| | | | | | |
|---|---|---|---|---|---|
| 3,610,558 | A | * | 10/1971 | Tawara | 248/44 |
| 3,674,612 | A | | 7/1972 | Gehl | 161/24 |
| 3,723,723 | A | | 3/1973 | Lerner | 240/10 |
| 3,770,651 | A | | 11/1973 | Corelli | 240/10 T |
| 3,970,834 | A | * | 7/1976 | Smith | 362/123 |
| 5,213,519 | A | | 5/1993 | Dorfman | 439/505 |
| 5,347,750 | A | * | 9/1994 | Mills | 47/30 |
| D384,174 | S | | 9/1997 | Smith | D26/25 |
| 5,746,504 | A | | 5/1998 | Dodson | 362/252 |
| 5,814,380 | A | * | 9/1998 | Tamborello et al. | 428/9 |
| 6,062,701 | A | | 5/2000 | Hines | 362/123 |

* cited by examiner

*Primary Examiner*—Deborah Jones
*Assistant Examiner*—Vivek Koppikar
(74) *Attorney, Agent, or Firm*—Charles Nessler

(57) ABSTRACT

A simulated Christmas tree is comprised of an array, or net, of interconnected light strings, tie wires and semi-rigid hoops. Spaced apart segments of light strings run downwardly from a hub which is at the top of a center pole that extends from a base. The light string segments are fastened to the horizontal hoops; and tie wires run horizontally between the segments, at elevations intermediate the hoops and intermediate the uppermost hoop and the hub which is at the top of the tree. The hoops create the conical shape. They are adapted to nest within one another, with clearance for the wires, and enable a knock down design. A detachable illuminated decoration is mounted on the hub at the pinnacle of the tree. The string light segments and bulbs in the star are electrically connected to blink, and to thus produce a twinkling tree effect.

8 Claims, 2 Drawing Sheets

SIMULATED CHRISTMAS TREE

This application claims benefit of provisional patent application Ser. No. 60/263,023, filed Jan. 19, 2001.

TECHNICAL FIELD

The present invention relates to simulated Christmas trees and the like, comprised of illuminated electric lights and supporting structure.

BACKGROUND

In connection with the Christmas holiday celebration, a traditional practice is to decorate a conical shape evergreen tree with lights. Typically that requires the effort and expense of purchasing a cut tree, erecting and decorating it with lights and the like. And, when the season is over, further effort is required to remove the decorations and dispose of the tree. In recent years, durable artificial plastic trees that look very much like traditional natural evergreen trees have been available. However, such trees are relatively bulky and awkward with respect to storing, when the Christmas season is over. And, as with natural cut trees, they are prone to be blown over in a storm unless properly mounted. Thus there is a continuing need for pleasing Christmas tree decorations which are economic and easy to erect and store.

For a number of years, string lights for Christmas trees and other decorations have been comprised of miniature electric light bulbs. The bulbs are mounted in sockets and connected by wires. They have become popular because they are durable and have relatively low cost. Such string lights, and other style light arrays, have been fabricated in various ways, in the forms of nets, to either make it easier to put them on conventional or artificial plastic trees. See U.S. Pat. No. 3,096,943 of Forrer, U.S. Pat. No. 3,723,723 to Lerner, U.S. Pat. No. 3,770,951 of Corelli, U.S. Pat. No. 4,404,621 to Mauro, and U.S. Pat. No. Des. 384,174 to Smith. In the prior inventions, a common approach is to have strings of lights run outwardly (downwardly) from a central point at the top of the tree.

Articles have been constructed using illuminated bulbs, to create the conical appearance of a Christmas tree. Often, they involve light strings held in place by mechanical components, such as a stand or frame. U.S. Pat. No. 5,359,502 to Cantin shows how lengths of plastic tubing are run upwardly from a base to converge at an apex, making a cone of tubing. A light string spirals downwardly around the cone shape of the frame. U.S. Pat. No. Des. 390,806 of Skarda, Jr. shows a similar tubular arrangement, but the light strings are run directly from the frame apex to the base, rather than spiraling. U.S. Pat. No. 6,062,701 to Hines describes a collapsible tree comprised of a series of hoops interconnected by plastic bands, supported from a center pole. Electric lights are mounted on each of the hoops. U.S. Pat. No. 4,620,270 of Laasko describes a simulated tree in which strings of lights run from a collar at the top of a collapsible center pole to spaced apart attachment points at a hoop like base at the bottom of the pole.

While all the foregoing prior art devices are collapsible in one way or the other, many of them involve a multiplicity of parts. That means that much time and labor must be consumed in assembling and disassembling them. In some of the prior art devices, the use of tubing creates an unwanted visual effect, compared to an effect in which the structure supporting the light arrays is inconspicuous. Generally, an ideal simulated tree will create a desired pleasing appearance, will be economic to manufacture, will require limited labor to assemble and disassemble, will be strong with respect to resisting the elements when installed outdoors, will be durable and long lasting, and will be compact to store. The present invention seeks to satisfy such criteria in a way, which is improved over the prior art.

SUMMARY

An object of the invention is to provide a simulated Christmas tree shape by means of interconnected electric light bulbs. A further object is to provide a simulated tree which is pre-assembled to a high degree, so little labor is required for assembly, but at the same time the tree should be collapsible into a compact shape for storage. A still further object is to provide an article, which is economic to manufacture, light in weight, and durable with respect to resisting elements when installed outside.

In accord with the invention a simulated tree, suitable for Christmas use, is comprised of a base, a center pole running upward from the base, and a hub at the top of the center pole. A multiplicity of light string segments run downwardly from the hub, along slant-heights of an imaginary cone. And, there is at least one hoop (preferably several) having a diameter greater than the hub, lying in a horizontal plane at an elevation lower than the hub. The hoops are attached to and suspended in space by the several light string segments. The hoop(s) makes the light string segments and their illuminated bulbs define a conical shape, thus simulating a Christmas tree shape.

Preferably, there are three hoops and they nest one within the other with clearance. One is near the base and the other two are at intermediate elevations. And there are horizontal tie wires which interconnect the light string segments at elevations between the hoops, to maintain good spacing of the segments. Miniature bulbs of the light strings are positioned at the intersections of the segments with the hoops and tie wires. The hoops are relatively rigid, compared to the flexible conductor wires of the string segments or the tie wires.

Thus, the combination of semi-rigid or stiff hoops, and flexible, wires provides a good uniform appearance to the tree during use. The combination also, but also enables the bulb array of the tree, or the net, to collapse into a flat shape for storage. To further carry out the object of collapsibility, or being able to be knocked down, the tree which has a center tree is comprised of three segments and it is detachable from the base. The hub is also detachable from the top of the pole. A pinnacle decoration, such as a star, detachably mounts on the top of the hub. Thus, the tree is adapted for knock down, and for convenient shipment and storage in a relatively small box.

Preferably, the light string segments are comprised of electrically separate strings. Thus, through the use of control bulbs or other means, the different strings/segments can be made to blink on and off at different times. A translucent illuminated star has bulbs which are electrically connected to at least two different strings, so the star blinks on and off at a rate twice the rate of any string.

The foregoing and other objects, features and advantages of the present invention will become more apparent from the following description of preferred embodiments and accompanying drawings.

DESCRIPTION

Electric string lighting (or simply, "strings" herein) comprises a multiplicity of miniature electric light bulbs (such as Type C6, C7 or C9 bulbs) spaced apart along electrical conductor wires. Typically, the bulbs are removably contained within sockets, to which the wiring runs. Typically, the bulbs of a string are connected in series which each other and a string can be connected directly to ordinary household alternating current. When there is series connection, the lights in a string can be made to blink on an off by means a control bulb inserted in the spring. A common control bulb will switch itself on and off—and thus all the bulbs which are wired in series with it, by means of an internal thermal element which alternately heats and cools, according to whether current is flowing or not. Normal and desirable variability amongst the control bulbs means that an assembly of different strings will blink in uncoordinated fashion. The bulbs of a light string can be made to blink on off, or stay on constantly, according to whether one of the bulbs is a control bulb or a common bulb. The present invention is sometimes called a twinkling net tree when the blinking control bulbs are used for all the light strings—or the network—of the tree. Of course, other circuitry can be used instead of thermal type control bulbs, to make the bulbs of a string blink.

Figure 1:
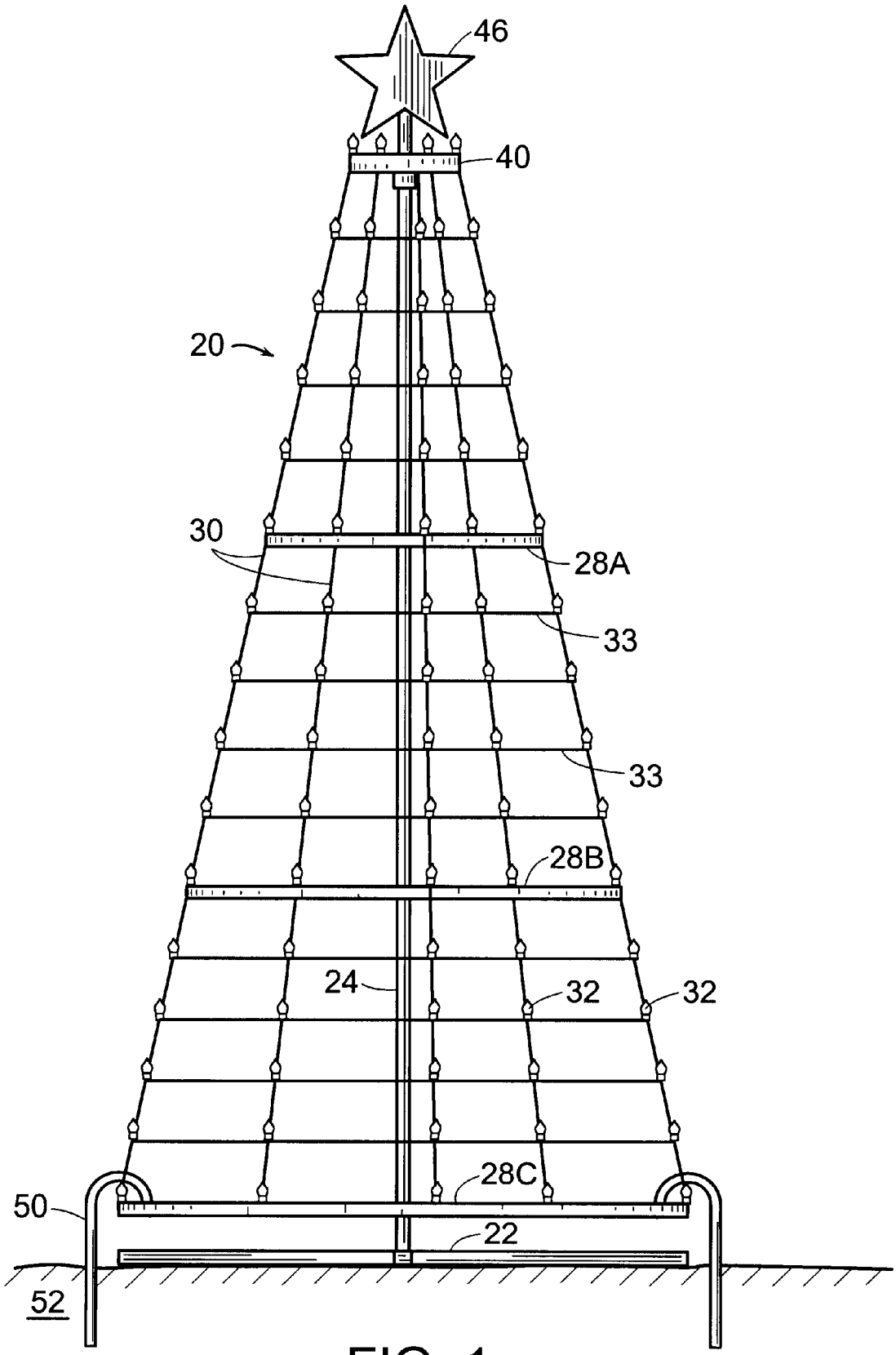
FIG. 1 is an elevation view of a simulated tree comprised of string lighting connected by hanging hoops, and a base and center pole.
Figure 2:
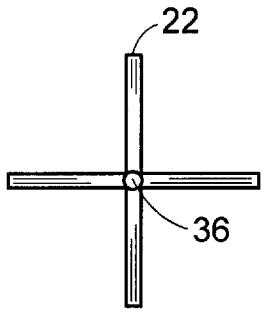
FIG. 2 is a top view of the base of the tree of FIG. 1.
Figure 5:
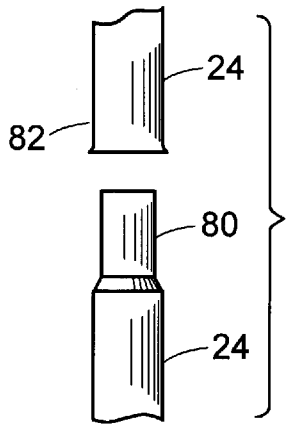
FIG. 5 shows how two segments of the center pole engage.

FIG. 1 is an elevation view of an assembly 20 which, when illuminated, produces the visual impression of a conical Christmas tree. For that reason, assembly 20 is referred to here simply as a "tree". Central pole 24 runs vertically up from a cross-shaped base 22, which is shown in top view in FIG. 2. The base is made of ⅜ inch welded steel rod. The pole 24 is comprised of three segments of hollow metal tubing. Each segment has a necked down male upper end 80 which slips into the larger female bottom end 82 of the next segment, except for the uppermost segment which has no necked down female end. See FIG. 5. The bottom segment of the pole 24 slips over peg 36 which is extends vertically upward from the center of base 22.

Figure 3:
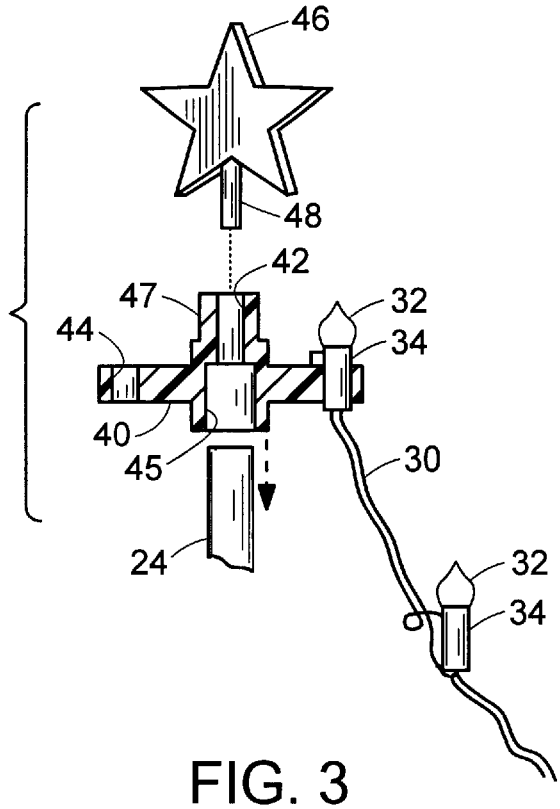
FIG. 3 is a cross section vertical center plane view of a hub, with a star, showing how light strings are hung from the hub and how the decorative star attaches to the top of the hub.
Figure 4:
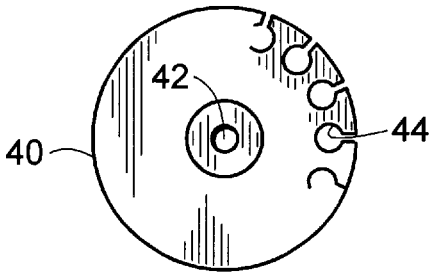
FIG. 4 is a top view of the hub.

At the very top of the pole is a lighted plastic star 46. With reference to FIG. 3 and 4, a circular plastic hub 40 is attached to the top of pole 24. A multiplicity of segments of electric light strings 30 hang from the hub 40. The spaced apart light string segments run downwardly and outwardly to define the conical surface which is being visually created, as illustrated by FIG. 1. Each string is comprised of a pair of electric wires with spaced apart miniature electric light bulbs 32, as described in the first paragraph here.

Preferably, there are 18 segments or runs of light string running from the hub. Each segment runs generally along a slant-height of the imaginary conical surface. The slant-height of a cone is a straight line running the shortest distance from the outside circumference of the base to the apex. The 18 segments are equally spaced apart around, and define, the outer circumference of the tree.

Electrically, the lighting system is divided into six separate strings. As is familiar for ordinary Christmas trees and lights, the separate strings are electrically joined together at the top and base, so they can be connected by a single cord to an electric power source (not shown). Nonetheless, since there are six separate strings (that is, six separate sets of 3 adjacent segments running along slant-heights); and the strings can, through the use of control bulbs or substitutional means, be made to blink in the absence of coordination with the other strings, to thus produce a twinkling tree effect.

Preferably, there are short segments of electric light strings, or other substitutional illumination, within the interior of the transparent or translucent hollow star. Electrically, the bulbs in the interior of the star are composed of two different short light strings. One short life string illuminates the tips of the star; the other illuminates the center. The two short strings in the star are electrically energized by connection to two of the six main strings. Thus, when the slant-height strings twinkle, the star will twinkle as well. But the star will twinkle twice as much as any slant-height segment.

Three vertically spaced apart horizontal plane hoops 28A, 28B and 28C circumscribe the pole 24 at elevations lower than the hub. The lower hoop 28C made be positioned at or even below the base elevation. The circular hoops are stiff and semi-rigid, being made of about ⅛ inch diameter welded steel wire or rod. (All the steel parts are painted or powder coated for appearance and protection.) Each lower hoop is larger than the one above, and their sizes are chosen so that they will nest one within the other, with come clearance for wires, as will be appreciated from the full description here. The light strings run along the slant-height.are attached to each hoop at equally spaced apart points around the hoop circumference.

The hoops are thus hung and supported in space from the top of the pole, since they are connected to the light string segments 30 which run along the slant-height, to the hub. Since the slant-height string segments 30 are attached to the hoops at equally spaced apart locations around the hoop circumferences, the strings diverge as they run toward the elevation of the base. So, it is the hoops which causes the strings to define in approximate regular fashion a conical surface which suggests a tree. Because of symmetry of construction, the hoops and the conical tree shape are more or less centered about the pole. The term elevation as used herein can refer to either the normal direction or the slant-height direction, since they are proportioned in a cone shape useful for the invention.

The wires of the light strings are flexible and thus incapable or resisting compressive force. The tie wires, discussed below, preferably have a similar characteristic. So, the hoops are semi-rigid; they have a material stiffness and shape which enables them to apply both compressive (pushing-apart) and tensile (pulling-together) forces to adjacent light string segments. Thus, the hoops keep the light string segments from moving toward each other; and from moving or inwardly toward the pole under force of gravity.

Tie wires 33, which do not carry current, run circumferentially to flexibly connect the string segments which run along the slant-heights, thus keeping them from getting too spaced apart. They mostly run at elevations where there are no hoops. However there are tie wires which correspond with elevations of the hoops. Being flexible, the tie wires allow string segments to move toward each other and the center pole, a bit. In an alternate embodiments, some or all of the tie wires could be relatively rigid, or they can be omitted.

The light strings and other components are configured so that there is a bulb 32 at the intersection of each string with a tie wire or hoop, which intersections are called nodes. While the preferred embodiment of tree is such as to create uniformity of spacing and symmetry in appearance, in the generality of the invention that need not be the case, and within a tree the string segment slant-height lengths and tie wire lengths can vary. Similarly, the hoops can be chosen so that the imaginary conical surface of the tree bows in or out along the slant-height.

FIG. 3 shows a side cross section view of the hub 40 with a star. The hub has a series of notched vertical holes 44 around its periphery. The top view of FIG. 4 illustrates only a portion of the 18 holes. The upper most bulb socket 34 of each slant-height segment slips into a hole 44 with a light press fit, to provide attachment. The socket has a shoulder or tab, to keep it from passing downward through the hole. See FIG. 3. Assembly of bulb sockets into the holes of the hub is done at the factory. The notches facilitate the assembly by providing for the wire running from the socket.

When the tree is collapsed in a box for shipment or storage, the sub-assembly comprising all the light strings and the hub is not taken apart. Also, the connections between the hoops and the segments, and the tie wires between the segments and the conductors of the light strings, are also left intact.

The hub 40 has a bore 45 so that it slips onto the top of the pole 24, as indicated by the arrow in FIG. 3. The hub has a boss 47 at its top, within which is a circular hole 42. The hole 42 receives the circular pin 48 which is a portion at the bottom of star 46. Star 46 is an optional decoration mounted at the pinnacle of the tree. It is made of hollow transparent plastic, and bulbs having wires running from two of the light strings within the interior (not shown).

The product is of knock-down construction, so it is suitable for being shipped in a relatively flat box. That capability should be in part apparent from the description above. The pole is made of telescoping segments. At the factory, all electrical connections are made, and the upper most sockets of the light strings are inserted into the hub, as described. When collapsed, the different size concentric hoops nest within one another and the flexible wires and strings fold in amongst the hoops. Preferably, there is extra length to the wires which run to bulbs inside the star. That enables the star to be positioned within the box in a good location. The lengths of the segments of the pole are approximately equal to the diameter of the larger hoop, which is approximately equal to the outer dimension of the base. Thus, all the components can be put into a relatively small carton.

Thus, the user who purchases the tree 20 has a simple assembly task. She first puts the segments of the pole 24 together and attaches the pole to the base. She then lowers the network of interconnected strings, tie wires and hoops, and hub, over the upper end of the pole. She puts the hub 40 onto the upper end of the pole. She then inserts peg 48 of star 46 into the hole 42 of the hub. She then connects the tree to a source of electric power. By reversing the foregoing steps, the tree can be quickly disassembled.

In an example of the invention, a tree like that described is about 72 inch high. The base outer dimension is about 24 inch. The pole is comprised of three segments, each about 24 inch long. There are three hoops, having diameters of about 7, 15 and 28 inch. They and the hub are spaced apart at about 22–25 inch, as measured along the slant-height. There are 18 runs or segments of equally spaced apart light strings, running along the slant-height. They are electrically connected as described. When collapsed for shipment, the tree fits into an about 31 by 29 by 3 inch box.

As shown in FIG. 1, to keep the unit from tipping over when there is a horizontal force, such as from the wind when the tree is installed outdoors, four or more J-shape metal or plastic hooks 50, are pressed into the earth 52, to capture and hold down the lower hoop. The downward pulling action of the hooks also tends to lessen any looseness or slight kinks in the light strings and to prevent the pole segments from separating in the event of unexpected force. Different means may be used for holding down the outer hoop, in exterior and interior locations. For instance, staples driven into a wooden floor surface may be used. While it is undesirable from the standpoint of product shipping weight, the lower hoop may be made of particularly heavy, to achieve a like effect. And, bases having different style and greater weight than those which are described above may be used.

The essential tree may be configured in different ways from that which is described above, within the scope of the invention. For example: Fewer and greater number of hoops or light string segments can be used. The hoops may be made non-circular and of a material other than steel, provided the other material has a stiffness and rigidity sufficient to resist compressive forces, as described above. The center pole may be made of fewer or more segments. Some or all of the components can be permanently attached to each other, so that the unit is not adapted to being knocked down. The tie wires may intersect the light string segments at locations spaced apart from where the bulbs are; or they may be omitted entirely when the hoops are sufficiently close or when a uniformity of segment spacing is not important. The connection between the hub and each individual downward run of light string segment may be different from that described—namely, having the uppermost bulb socket sit in a peripheral hole of the hub. For instance, the socket which is held by the hub may be other than the uppermost one, so that one or more bulbs of the string segment are above the hub elevation. For instance, each light string segment may be clipped to the outside surface of a hub having no peripheral holes. The hub may be made non-circular. The means by which the star or other pinnacle decoration mounts on the hub may be varied. For instance, different shape male and female cavities may be used; and, a screw or clip may be used.

While the illuminated bulbs which comprise the light strings are preferred for obvious reasons, the mechanical construction of a tree which has been described can be used with bright ornamentation other than bulbs. While the tree is referred to as a Christmas decoration, it may be used for other decorative purposes. The star at the top may be omitted or replaced by some other pinnacle decoration, with or without interior lights. The illumination of the star may comprise individual bulbs rather than segments of light strings. The tie wires may run vertically and the light string segments run circumferentially. While the invention has been described in terms of current technology miniature bulb electric light strings, newer or older illumination technology may be substituted.

Although this invention has been shown and described with respect to a preferred embodiment and some variations, it will be understood by those skilled in this art that various further changes in form and detail thereof may be made without departing from the spirit and scope of the claimed invention.

I claim:

1. A simulated conical shape tree comprised of:

a base, for supporting a pole when placed on a surface;

a pole extending upwardly from the base;

a hub mounted at the top of the pole;

a multiplicity of spaced apart segments of electric light strings, each string comprising multiplicity of miniature electric light bulbs, attached to the hub and running downwardly from the hub toward the base; the segments running along spaced apart slant heights of an imaginary cone;

a multiplicity of hoops, each hoop connected to and supported at spaced apart locations along the hoop by said multiplicity of light string segments, each hoop lying in a different horizontal plane at an elevation lower than the elevation of the hub; and a multiplicity of the wires, running horizontally at elevations between the elevations of the hoops, for connecting adjacent light string segments, and for controlling the lateral spacing apart thereof;

wherein, said multiplicity of miniature electric light bulbs are located so they are proximate to the points of interconnection of light string segments with hoops and the points of interconnection of light string segments with tie wires.

2. The tree of claim 1, adapted for being knocked down for shipment or storage, wherein the pole is comprised of a multiplicity of pole segments, wherein all segments have lengths which are no greater in dimension than the dimension of the outside diameter of the largest hoop comprising said multiplicity of pole segments; and wherein the hub is detachable from the top of the pole and the pole is detachable from the base.

3. The tree of claim 2 wherein the hub further comprises a part for receiving a portion of a pinnacle decoration; further comprising: a lighted pinnacle decoration mounted on the hub, the decoration having a portion shaped to removably fit in said hub part; to thereby enable the decoration to be removably attached to the hub and to extend upwardly from the hub when mounted thereon.

4. The tree of claim 1 further wherein said electric light string segments are comprised of miniature bulbs mounted in spaced apart sockets connected by conductor wires; and wherein said hub has a plurality of holes spaced apart around the hub periphery; each hole shaped to receive a socket of a light sting segment;

wherein, one socket from each of said light string segments is captured within one of said holes of the hub, to thereby provide said attachment between the segment and the hub.

5. The tree of claim 1 further comprising: means, for holding the lowermost hoop in proximity to the surface on which the base rests.

6. The tree of claim 5 wherein said means for holding comprises J-shape hooks adapted to be immersed within the material of the surface.

7. The tree of claim 1, wherein said electric light string segments comprise portions of at least two electrically separate light strings, further comprising: means for causing the bulbs of each light segment to blink on and off, wherein at least two different segments blink on and off at different times, when all the light strings are energized by electric power.

8. The tree of claim 6 further comprising;

a pinnacle decoration illuminated by electric bulbs positioned within the decoration, wherein the bulbs are divided between at least two electrically different circuits;

wherein, said at least two different pinnacle decoration bulb circuits are electrically connected to two different slant-height light strings which blink on and off, so the decoration bulbs of the two different circuits go on and off in coordination therewith; and so that the frequency of blinking of the star is at least twice as often as the frequency of blinking of any light string segment.

* * * * *